US006230686B1

(12) United States Patent
Lengowski

(10) Patent No.: US 6,230,686 B1
(45) Date of Patent: May 15, 2001

(54) FUEL INJECTION VALVE FOR INTERNAL COMBUSTION ENGINES

(75) Inventor: Michael Lengowski, Litzendorf (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/509,771

(22) PCT Filed: May 26, 1999

(86) PCT No.: PCT/DE99/01543

§ 371 Date: Jul. 7, 2000

§ 102(e) Date: Jul. 7, 2000

(87) PCT Pub. No.: WO00/08332

PCT Pub. Date: Feb. 17, 2000

(30) Foreign Application Priority Data

Jul. 31, 1998 (DE) ..... 198 34 475

(51) Int. Cl.[7] ..... F02M 33/04
(52) U.S. Cl. ..... 123/470
(58) Field of Search ..... 123/470, 468, 123/469; 277/166

(56) References Cited

U.S. PATENT DOCUMENTS 3,038,456 * 6/1962 Dreisin ..... 123/470
3,382,851 * 5/1968 Luca ..... 123/470
4,133,321 * 1/1979 Hofmann ..... 123/470
4,528,959 * 7/1985 Hauser, Jr. ..... 123/470
4,589,596 * 5/1986 Stumpp et al. ..... 123/470
5,129,658 * 7/1992 Berton et al. ..... 277/37
6,119,658 * 9/2000 Jahle et al. ..... 123/470

* cited by examiner

*Primary Examiner*—Thomas N. Moulis
(74) *Attorney, Agent, or Firm*—Ronald E. Greigg; Edwin E. Greigg

(57) ABSTRACT

A fuel injection valve for internal combustion engines, having a cylindrical valve body whose outside diameter decreases, forming an annular shoulder, in the direction of an injection opening. The valve body is braced axially against a holding body by means of a tension nut engaging the annular shoulder. The fuel injection valve is inserted into a stepped receiving bore in the housing of the engine, and the bore is sealed off via a sealing ring fastened between an annular end face of the tension nut and a housing shoulder of the receiving bore. The sealing ring disposed in axially secured fashion on the reduced-diameter shaft portion of the valve body, is characterized in that the sealing ring has a central circular opening, which is deformed in a defined way after being slipped onto the shaft part of the valve body.

6 Claims, 1 Drawing Sheet

FUEL INJECTION VALVE FOR INTERNAL COMBUSTION ENGINES

PRIOR ART

The invention relates to a fuel injection valve for internal combustion engines.

One such fuel injection valve is disclosed in German Patent Disclosure DE 19 605 956 A1, for example.

In this fuel injection valve disposed axially secured on the shaft of the valve body, so that the valve is assured that it can be removed from the receiving bore jointly with the valve body of the injection valve. To that end, the sealing ring is fastened by frictional engagement on the valve body shaft, and this frictional engagement is built up preferably only in portions that are distributed symmetrically over the circumference. These portions are in particular three radially inward-protruding formed-on features of the inner wall surface of the sealing ring whose cross-section is reduced compared with the thickness of the sealing ring. The sealing ring then holds by being pressed down on. Since the sealing ring now comprises a very soft material, in particular copper, the inward-protruding formed-on features cannot be prevented from being at least partly ground down on being mounted on the shaft part of the valve body, in which case they will clamp only lightly. Because of this light clamping, the sealing ring can undesirably come loose from the shaft part of the valve body.

The object of the invention is therefore to refine a fuel injection valve for internal combustion engines of the type defined generically above such that on the one hand, the sealing ring can be mounted in a simple way on the shaft part of the valve body and can be secured on the sealing ring in such a way that unintended loosening of the sealing ring from the shaft part can practically no longer occur.

ADVANTAGES OF THE INVENTION

This object is attained, in a fuel injection valve for internal combustion engines of the type described at the outset, according to the invention, the sealing ring has a central opening, which is deformable in a defined way after being slipped onto the shaft part of the valve body. Such an embodiment of the sealing ring has the advantage that on the one hand, because of the central circular opening, the sealing ring can be slipped easily over the valve shaft and can then be deformed with a pressing tool in such a way that at the points of the deformation the sealing ring flows toward the shaft part of the valve member, is forced into the ground surface of the shaft part, and is thus held solidly and in captive fashion thereon. To assure the most uniform possible distribution of force both on the sealing ring and on the shaft part of the valve member, it is advantageously provided that the sealing ring is deformed only in portions of its inner wall surface of the central circular opening, and these portions are preferably distributed uniformly over the circumference of the sealing ring.

An especially advantageous embodiment provides that the sealing ring is preferably deformed at three points distributed uniformly over its circumference.

To enable easy deformation of the sealing ring and in particular to assure that the shaft part of the valve body will not be deformed, the sealing ring is advantageously made from a softer material than the valve body, preferably from copper.

The fastening of the sealing ring on the shaft part of a fuel injection valve of the type described above is advantageously effected in that the sealing ring, after being slipped over the shaft part, is deformed with a pressing tool in such a way that a flow of material toward the shaft part occurs.

As a result, in particular in an especially advantageous way, the sealing ring is prevented from grinding in any way on the shaft part of the valve body as it is being slipped onto the shaft part, thus averting the wear phenomena as described above.

BRIEF DESCRIPTION OF THE DRAWING

Further advantages, advantageous features, and characteristics of the subject of the invention can be learned from the ensuing description, the drawing and the claims.

Shown in the drawing are.

DESCRIPTION OF THE EXEMPLARY EMBODIMENTS

Figure 1:
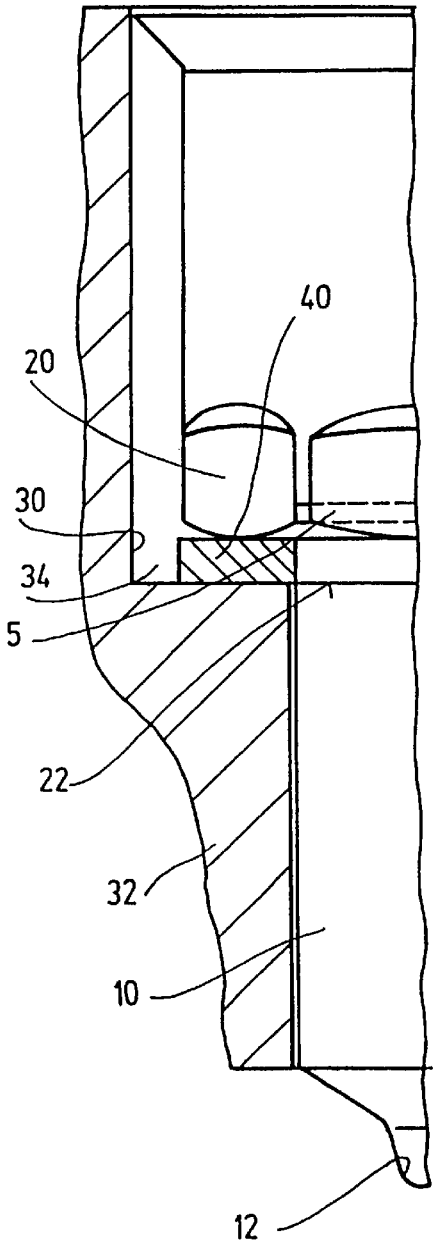
FIG. 1, partly in section and cutaway, the lower part of a fuel injection valve with a sealing ring slipped onto the lower part.

A fuel injection valve for internal combustion engines that is shown in an enlarged detail in FIG. 1 has a cylindrical valve body, whose outside diameter decreases, forming an annular shoulder. A reduced-diameter shaft part 10, on its free end, has at least one injection opening 12 that discharges into the combustion chamber, not otherwise shown, of the engine.

The valve body is braced axially against a holding body (not shown) on its end remote from the injection opening 12 by means of a tension nut 20 engaging the annular shoulder 5. This holding body has a connection stub for an injection line, not shown, to an injection pump and has a pressure conduit for delivering the fuel, which is at high pressure, to the injection valve, as disclosed by German Patent Disclosure DE 19 605 956 A1, which is hereby entirely incorporated by reference.

The valve member is guided axially in the valve body in a manner known per se; by its reciprocating motion, it opens and closes an opening cross section in the injection valve.

The injection valve is inserted into a stepped receiving bore 30 in the housing 32 (cylinder head) of the engine to be supplied with fuel, and the reduced-diameter region of this bore discharges into the engine combustion chamber.

To seal off the part of the receiving bore 30 toward the combustion chamber, a sealing ring 40 is fastened between an annular end face 22 of the tension nut 20 and a housing shoulder 34 formed at the cross-sectional transition of the receiving bore 30, and the sealing ring is guided on the shaft 10 of the valve body.

Figure 2:
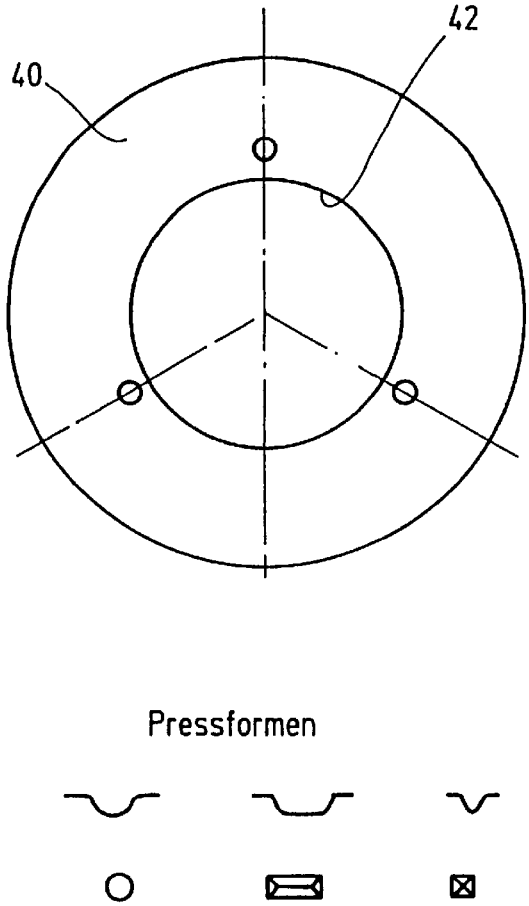
FIG. 2, an end view of a sealing ring and various die forms, shown schematically, for purposeful deformation of the sealing ring.

This sealing ring 40, shown in plan view in FIG. 2 and preferably made of copper, has a central circular opening 42, preferably a bore, which is slightly larger than the outside diameter of the shaft part 10 of the valve body.

In this way, the sealing ring 40 can be easily thrust with little clearance over the shaft part 10 of the valve body. Once the sealing ring 40 has been slipped onto the shaft part 10 of the preassembled injection valve until it contacts the annular end face 22 of the tension nut 20, it is deformed in a defined way by means of a pressing tool. As shown in FIG. 2, it is preferably deformed at three points uniformly distributed over the circumference, and the die forms shown in FIG. 2 are conceivable. These die forms can for instance have a round shape or a rectangular or square, conically extending shape. By means of the defined deformation of the sealing ring 40, the copper at the points of the deformation begins to flow slightly in the direction of the shaft part 10 of the valve body and to press into the ground surface of the shaft part 10, as a result of which the sealing ring 40 is retained. The advantage of this sealing ring and of the method of its assembly is that the sealing ring on being slipped onto the shaft part 10 is not subjected to any mechanical stresses whatever and thus is not subject to any wear phenomena, either.

The lower portion of FIG. 2 shows in somewhat schematic fashion the die forms used to make the deformations indicated in the upper portion of FIG. 2 by the three small circles. In particular, the lower portion of FIG. 2 shows two rows of indicia, the upper row representing three variations of the pressing die forms, and the lower row of indicia representing the impression made by each respective die form. Any means can be used to press the die forms into the sealing ring, as long as the die forms are pressed with sufficient force. In the showing in the upper part of FIG. 2 it is seen that the die forms are pressed close to the inner diameter of the sealing ring. It should be noted that the impressions need only be close enough to the inner diameter so that in the process of forming the impressions, the flow of the material of the sealing ring will include sufficient flow towards the inner diameter so that the sealing ring will now engage the shaft of the fuel injection valve. This effectively makes the sealing ring and fuel injection valve into a preassembled unit which is then placed into the bore 30 of the engine housing 32.

The foregoing relates to a preferred exemplary embodiments of the invention, it being understood that other variants and embodiments thereof are possible within the spirit and scope of the invention, the latter being defined by the appended claims.

What is claimed is:

1. A fuel injection valve for internal combustion engines, comprising a cylindrical valve body whose outside diameter decreases toward a fuel injection end, forming an annular shoulder (5), in a direction of an injection opening (12), said valve body is braced axially against a holding body by means of a tension nut (20) engaging the annular shoulder (5), and the fuel injection valve is inserted into a stepped receiving bore (30) in a housing (32) of the engine, said bore is sealed off via a sealing ring (40) fastened between an annular end face (22) of the tension nut (20) and a housing shoulder (34) of the receiving bore, and the sealing ring (40) is disposed in an axially secured fashion on the reduced-diameter shaft portion (10) of the valve body, the sealing ring (40) has a central circular opening (42), which is deformed in a defined way after being slipped onto the shaft part (10) of the valve body the sealing ring (40) being deformed in its defined way by means of pressing die forms against the sealing ring so as to deform the sealing ring and cause flow of the material of the ring towards the inner diameter of the sealing ring, and thus towards the shaft of the fuel injection valve, such flow being sufficient so that the sealing ring engages the fuel injection valve.

2. The fuel injection valve according to claim 1, in which the sealing ring (40) is deformed only in portions of an inner wall surface of the central circular opening (42), and these portions are preferably distributed uniformly over a circumference of the sealing ring (40).

3. The fuel injection valve according to claim 2, in which the sealing ring (40) is deformed at three points distributed uniformly over a circumference of the sealing ring.

4. The fuel injection valve according to claim 1, in which the sealing ring is made from a softer material than the valve body.

5. A method for fastening a sealing ring (40) to a shaft part (10) of a fuel injection valve for internal combustion engines which comprises slipping the sealing ring over one end of a shaft part, the sealing ring (40), after being slipped over the shaft part (10), is deformed with a pressing tool in such a way that a flow of material toward the shaft part (10) occurs.

6. The fuel injection valve according to claim 4, in which the sealing ring is made from copper.

* * * * *